United States Patent [19]

Smith

[11] 3,978,604

[45] Sept. 7, 1976

[54] TRIGGER INHIBITING MECHANISM

[76] Inventor: Joseph E. Smith, 1137 Sherwood Court, Sunnyvale, Calif. 94087

[22] Filed: Dec. 9, 1974

[21] Appl. No.: 530,891

[52] U.S. Cl. ..... 42/70 E; 42/1 MH; 42/1 Y

[51] Int. Cl.[2] ..... F41C 17/02; F41C 27/00

[58] Field of Search ..... 42/70 E, 1 Y, 1 MH

[56] References Cited

UNITED STATES PATENTS

| | | | |
|---|---|---|---|
| 2,401,482 | 6/1946 | Hendey | 42/70 E |
| 2,874,503 | 2/1959 | Niesp | 42/70 E |
| 2,979,845 | 4/1961 | Christiansen | 42/70 E |

*Primary Examiner*—Charles T. Jordan
*Attorney, Agent, or Firm*—Townsend and Townsend

[57] ABSTRACT

Trigger safety device for firearms is provided having a pivotally mounted magnetically attractable bar positioned on the inside of the handle adjacent the trigger, with the bar directed toward the trigger or on the rear of the trigger, with the bar directed toward the handle. When the pin is oriented centrally, sufficient movement of the trigger is inhibited to prevent firing. The bar is mounted in a non-magnetizable casing. The user of the gun, by wearing a magnetic ring, displaces the bar from its central orientation and allows for sufficient movement of the trigger for firing.

12 Claims, 8 Drawing Figures

TRIGGER INHIBITING MECHANISM

BACKGROUND OF THE INVENTION

1. Field of the Invention

There is a well-recognized need to prevent the undesired firing of a firearm when loaded. Many accidents occur where the gun is fired despite the fact that the holder does not pull the trigger. Also, of concern with law enforcement officers, is the loss of their gun during an investigation or altercation, where the law enforcement officer is disarmed and threatened with his own gun.

A simple device is desirable which would prevent other than the owner from firing a firearm. Also, it would be useful to have a protective device which would prevent accidental firing of a firearm by other than the owner of the firearm.

BRIEF DESCRIPTION OF THE PRIOR ART

A number of sophisticated protective devices have been provided for firearms. The following U.S. patents describe such devices: U.S. Pat. Nos. 2,195,693, 2,401,482, 439,055, 2,979,845, and 3,031,787.

SUMMARY OF THE INVENTION

A simple safety device is provided employing a magnetically attractable bar pivotally mounted on the back of the trigger or in the gun stock housing and pointing in an upright position. The bar is balanced about the pivot point, so as to maintain a center position, whereby it inhibits the retraction of the trigger a sufficient distance for firing. A weak magnet is positioned to aid a non-magnetic bar to maintain the center position, while a magnetic bar will be centered by the steel trigger. The user of the firearm wears a magnetic ring, which attracts the bar and moves it out of confrontation, so as to allow for the firing of the firearm.

DESCRIPTION OF THE SPECIFIC EMBODIMENTS

A simple efficient device is provided as a safety mechanism to prevent accidental misfiring of a firearm, as well as inhibiting unauthorized users from firing the firearm. The subject device is operable by both left and right-handed users and is not readily interfered with by an unauthorized user. The device is relatively foolproof in requiring the user to have a magnet before the trigger can be moved to actuate the firing pin. The subject device fits into the space or well between the trigger and the handle or butt of firearms, without substantial modification of the firearm. Furthermore, the space is kept sufficiently small, so that the device cannot be manually manipulated. In addition, the subject device is reliable and remains operative during normal cleaning operations for pistons, such as ultrasonic cleaning.

The subject device comprises a pivotally mounted ferruginous pin or bar, which is balanced about the pivot. The bar is positioned either on the back of the trigger or in the handle or butt near the roof of the well defined by the trigger, stock and handle, so as to be directed toward the confronting surface. Stops are provided to prevent the bar from swinging too far from the midpoint or desired plane. The bar is retained substantially in a plane through the long axis of the barrel dividing the firearm in half.

Depending upon the material of the firearm to which the device is attached, the swivel bar will be a magnetic or a non-magnetic ferruginous material. Preferably, the firearm handle or butt (hereinafter "handle" will intend handle of a pistol and stock of the rifle behind the trigger) would be of a non-magnetic nonferruginous material and the trigger would be of a ferruginous material. In this manner, a magnetic bar would be centered by its attraction to the trigger and held in that position until attracted or repulsed by a magnet. Where the bar is mounted onto a ferruginous material, the bar will be a non-magnetic ferruginous material. A weak magnet may be employed adjacent the end opposite the confronting end of the bar, so as to align the bar in the central position for a nonferruginous bar. Conveniently, the bar may be mounted in a nonferruginous housing, e.g. metal or plastic, which is mounted on or in the handle or butt of the firearm, so that only a small portion of the bar extends from the housing.

For further understanding of the invention, the figures will now be considered.

Figure 1:
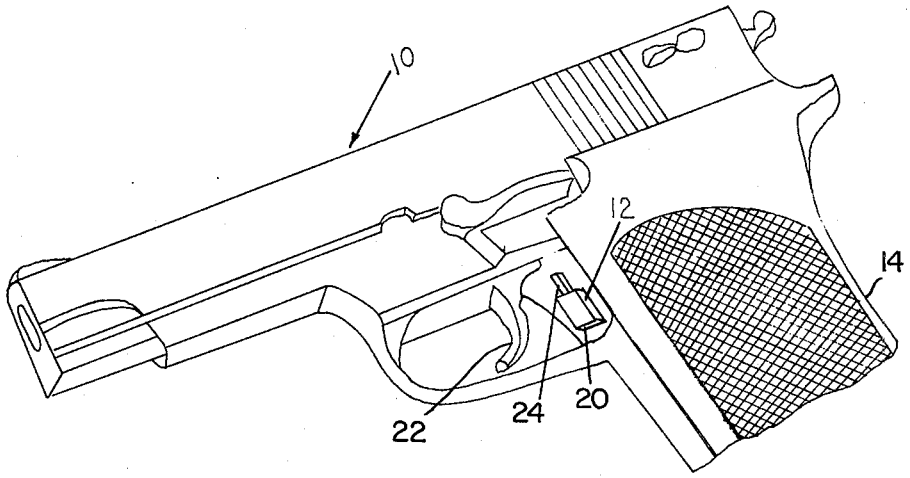
FIG. 1 is a fragmentary perspective view of a hand pistol with the safety device attached to the handle.

In FIG. 1, a pistol 10 is shown with the safety device 12 mounted on the pistol handle 14. The swivel bar 16 extends from the nonferruginous housing 20 in confronting relationship with trigger 22.

Figure 2:
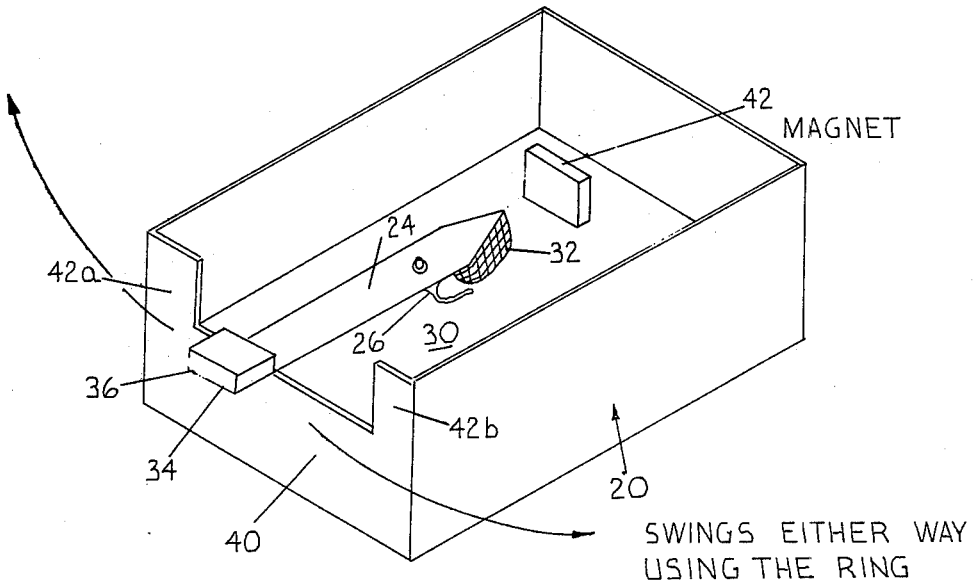
FIG. 2 is a perspective view of one embodiment of the safety device.
Figure 5:
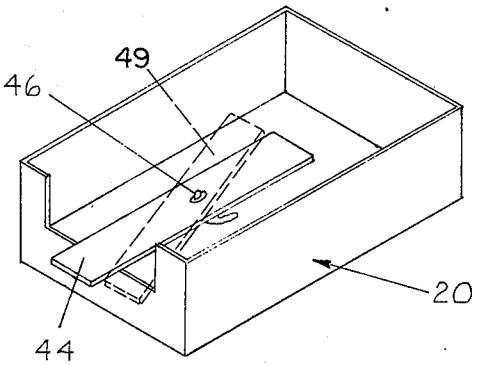
FIG. 5 is a perspective view of an alternate embodiment of the safety device.

Two different embodiments of the safety device are depicted in FIGS. 2 and 5. In FIG. 2, a non-magnetic ferruginous bar 24 is pivotally mounted on post 26, which is affixed to the housing floor 30. The bar 24 has weight 32, ferruginous and pointed at one end, which serves to balance the bar and keep the bar in the center position of the rear magnet 42. At the opposite end 34 of the bar 24 is a ferruginous block 36, which is attracted to an iron-containing or magnetic material, respectively. The front wall 40 of the housing 20 has an aperture with side walls **42*a* and 42*b*, which serve as stops to prevent bar 24 from moving too far to either side. In this way, the bar 24** remains centered in confronting relationship with the trigger or handle.

The housing 20 is conveniently of metal or plastic, and preferably of a nonferruginous material. In this manner, the housing does not interfere with the movement of the bar 24 or create any drag on the bar 24.

In FIG. 5, the alternate embodiment has housing 20 and magnetic bar 44. Magnetic bar 44 is pivotally mounted on post 46 at its center of gravity, so as to be balanced about the pivot point. The bar is shown in the safety position. The bar 49 in phantom is shown in the firing position.

Figure 7:
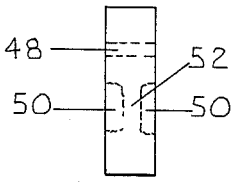
FIG. 7 is a rear elevation view of the trigger.
Figure 4:
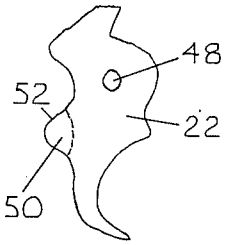
FIG. 4 is a side elevation view of a modified trigger.

When the safety device 12 is mounted on the handle, the trigger 22, as depicted in FIGS. 4 and 7, is notched on each side to provide indents 50 and leave a center projection 52, which is in confronting relationship with the swivel bar 16. The portion of the trigger 22, which is notched, is a projection of the trigger behind and below the pivot pin sleeve 48.

Figure 3:
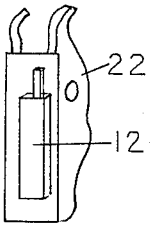
FIG. 3 is a perspective view of the trigger with the safety device mounted on its rear.

In FIG. 3, the safety device 12 is mounted onto trigger 22. When mounted onto trigger 22, the swivel bar will confront the handle. Portions of the handle, such as aluminum handle, are notched, comparable to the notching of the trigger, to allow for the retraction of the trigger without the swivel bar encountering the handle.

Figure 6:
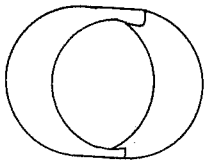
FIG. 6 is a perspective view of a magnetic ring.

In FIG. 6 is depicted a magnetic ring which is worn on the trigger finger of the firearm user. When the trigger finger is placed on the trigger, the magnetic ring attracts the swivel bar 16 moving it out of confronting relationship with the projection present on the handle or trigger. The trigger is then free to be retracted for firing.

The size of the well between the trigger and handle will vary depending on the nature of the firearm. In some instances, it will be necessary or desirable to hollow out a portion of the handle for insertion of the safety device. The amount of the upper portion of the handle that must be removed can be readily determined in accordance with the dimensions of the various parts involved. The particular angle at which the swivel bar confronts the trigger rear is also a matter of accommodation.

Where a nonferruginous handle is employed, a magnetic swivel bar can be directly incorporated into the firearm handle at the time of manufacture, while any non-magnetic material may be used for the handle with a non-magnetic swivel bar. A housing for the swivel bar could be provided, molded integrally with the handle or stock, and the swivel bar pivotally mounted in the housing. The housing would serve as the stop.

Figure 8:
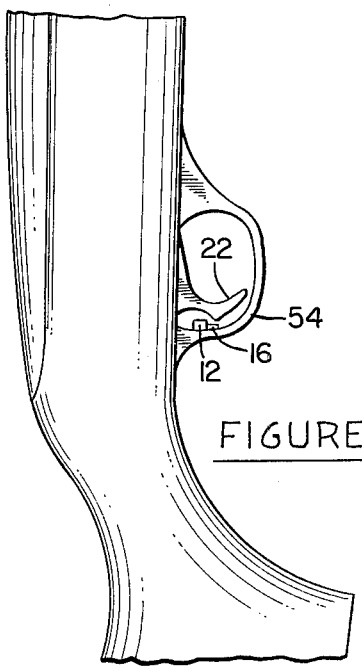
FIG. 8 is a side elevation view of a rifle with the safety device attached to the trigger protector.

In FIG. 8 is depicted the safety device 12 mounted onto the trigger protector 54 of a rifle. In its rest position the swivel bar 16 blocks the movement of the trigger 22 preventing the weapon from being fired.

The safety device which has been employed was with a Smith & Wesson Automatic Model 59 and was quite small with its largest dimension a fraction of an inch. The housing will be from about 0.2 to 0.4 inch in width and about 0.3 to 0.6 inch in length with the bar about 0.4 to 0.6 inch in length, and the swivel bar extending from about 0.2 to 0.4 inch from the housing. The bar should be of a strong material, but relatively light and be pivotally mounted with a minimum of drag. The bar can be as little as about 25 mils in thickness, although somewhat greater thicknesses are preferred.

The subject invention provides a simple device which acts as a safety feature in the use of firearms. It is particularly useful where unauthorized users are to be prevented from firing the firearm. This includes children and accidents, such as having a shotgun fall from being propped against a tree. Law enforcement officers, who carry weapons normally loaded, are protected from having the weapon taken from them and fired at them by employing the subject device. Also, accidental misfiring is inhibited, since the swivel bar will prevent the trigger from being retracted unless it has pivoted to the side. Other advantages with law enforcement officers is the elimination of setting the safety catch, since the pistol is normally carried loaded. The subject invention also eliminates the time required to remove the safety, so that the officer may act more rapidly.

Although the foregoing invention has been described in some detail by way of illustration and example for purposes of clarity of understanding, it will be obvious that certain changes and modifications may be practiced within the scope of the appended claims.

What is claimed is:

1. A safety device for preventing unauthorized firing of a weapon having a trigger and a handle comprising:

a nonferruginous housing for mounting about the handle of said weapon;

a magnetically attractable bar extending outwardly from said housing, pivotally mounted in said housing and balanced about the pivot;

stop means for preventing said bar from pivoting beyond a predetermined arc; and magnetic means for maintaining said bar in a position subsequently in the center of said arc.

2. A device according to claim 1, wherein said magnetic means is said bar composed at least in part of a magnetic material, which is attracted by said trigger when said device is mounted on said handle.

3. A safety device according to claim 1, wherein said magnetic means is a magnetic member mounted symmetrically to said bar to the rear of said housing.

4. A firearm having a safety device according to claim 1, mounted about said handle in facing relationship with said trigger, wherein said trigger is notched on either side of the portion of said trigger in facing relationship with said bar, to allow for retraction of said trigger when said bar is pivoted from its central position.

5. A firearm according to claim 4, wherein said firearm is a pistol.

6. A firearm according to claim 5, wherein said pistol has an aluminum handle and said bar is magnetic.

7. A firearm according to claim 4, wherein said firearm is a rifle.

8. A device according to claim 1, wherein said housing is for mounting about the handle of said weapon in facing relation with said trigger.

9. A firearm with a ferruginous trigger and a nonferruginous handle having a pivotally mounted magnetic bar mounted in the handle of said firearm in proximity to the trigger with one end of said bar in facing relationship with the rear of said trigger, wherein said trigger is notched in the rear to leave a central projection which engages said bar upon retraction of said trigger; and stop means for restraining the movement of said bar in a predetermined arc.

10. A safety device preventing unauthorized firing of a weapon having a trigger and a handle comprising:

a nonferruginous housing for mounting on the rear of the trigger;

a magnetically attractable bar extending outwardly from said housing, pivotally mounted in said housing and balanced about the pivot;

stop means for preventing said bar from pivoting beyond a predetermined arc; and magnetic means for maintaining said bar in a position substantially in the center of said arc.

11. A device according to claim 10, wherein said housing is for mounting on the rear of the trigger in facing relationship with said handle.

12. A safety device for preventing unauthorized firing of a weapon having a trigger and means confronting the trigger comprising:

a magnetically attractable bar pivotally mounted with respect to said trigger confronting means and balanced about the pivot;

stop means for preventing said bar from pivoting beyond a predetermined arc; and magnetic means for maintaining said bar in a position of said arc preventing the actuation of said trigger firing said weapon.

* * * * *